US005554008A

United States Patent [19]

Porel

[11] Patent Number: 5,554,008

[45] Date of Patent: Sep. 10, 1996

[54] HIGH-PRESSURE PUMP TO FEED INTERNAL-COMBUSTION ENGINE FUEL-INJECTIONS

[75] Inventor: Louis-Claude Porel, Jeanmenil, France

[73] Assignee: Hydro Rene Leduc, Azerailles, France

[21] Appl. No.: 266,604

[22] Filed: Jun. 28, 1994

[30] Foreign Application Priority Data

Jun. 17, 1994 [FR] France ..... 94 07493

[51] Int. Cl.[6] ..... F04B 1/14

[52] U.S. Cl. ..... 417/269; 417/570; 92/128; 384/625

[58] Field of Search ..... 417/269, 570; 92/128; 384/2, 625, 912

[56] References Cited

U.S. PATENT DOCUMENTS 4,520,712 6/1985 Hovorka et al. ..... 417/269
5,354,181 10/1994 Porel ..... 417/269

FOREIGN PATENT DOCUMENTS 3728448 5/1988 Germany ..... 417/269
1751391 7/1992 U.S.S.R. ..... 417/269

*Primary Examiner*—Charles Freay
*Attorney, Agent, or Firm*—Lowe, Price, Leblanc & Becker

[57] ABSTRACT

The casing of the high-pressure pump consists of two integral segments. The first segment comprises a cylindrical borehole receiving the pump shaft 5 and its ball bearings 4. The second segment 1*b* comprises another borehole receiving a swash plate 9 rigidly affixed to the pump shaft 5, a cylindrical core 11 with parallel sides 11*a*, 11*b* and crossed by a plurality of open-end boreholes 12 receiving the pistons 13, a second cylindrical core 16 bearing check-valves 17, and a plug 19 resting against a shoulder 18 of the second core 16 in such manner as to keep the cores 11 and 16 compressed against each other and resting against a circular stop 7 in the second segment 1*b* of the pump casing 1. The inner boreholes of the two segments 1*a* and 1*b* are separated by a seal 2 and the parts located in the second segment 1*b* are in contact with the injection gasoline.

12 Claims, 2 Drawing Sheets

HIGH-PRESSURE PUMP TO FEED INTERNAL-COMBUSTION ENGINE FUEL-INJECTIONS

FIELD OF THE INVENTION

The use of fuel injectors in internal-combustion engines is known. However high-pressure pumps (about 140 bars) are needed to feed such engines but the manufacture of such pump is very delicate because the viscosity and the lubrication of gasoline are very low and as a result these pumps are very costly.

The present invention concerns such a pump which offers the very substantial advantage of being simple and very economical without susceptibility to seizing in spite of gasoline's lack of any lubricating effect, especially when unleaded.

BACKGROUND ART

The use of fuel injectors in internal-combustion engines is known. However, high-pressure pumps (about 140 bars) are needed to feed such engines because the viscosity and the lubrication of gasoline are very low and as a result these pumps are very costly.

The pump of the present invention comprises swash plates and hollow axial pistons each with a partly spherical head resting on a stud sliding on the surface of the inclined plate which in turn rotates inside an intake chamber filled with the liquid being pumped and comprising a crescent-shaped groove allowing suction through the studs and the piston heads, being characterized in that the pump casing consists of two integral segments, the first segment comprising a cylindrical borehole receiving the pump shaft and the ball-bearings supporting it, whereas the second segment comprises another borehole receiving a swash plate rigidly affixed to the pump shaft, further a cylindrical core with parallel end sides and crossed by a series of open-ended boreholes to receive the pistons, further a second core of which the planar front side is forced against the planar rear side of the first core, said second core bearing check-valves opposite each open-ended borehole while its rear part comprises a circular shoulder, and a plug screwed to the end of said second borehole and resting against the shoulder of the second core in such manner that the two cores shall be compressed against each other while resting against a circular stop in the second segment of the pump casing in the vicinity of the front side of the first core, the two segments of the pump casing being separated from each other by a seal in such a way that only the parts of the second segment will be in contact with the gasoline to be injected.

BRIEF DESCRIPTION OF THE DRAWINGS

Illustratively, and to elucidate the invention, an embodiment is shown in longitudinal section in the attached drawing.

DESCRIPTION OF THE PREFERRED EMBODIMENTS

Figure 1:
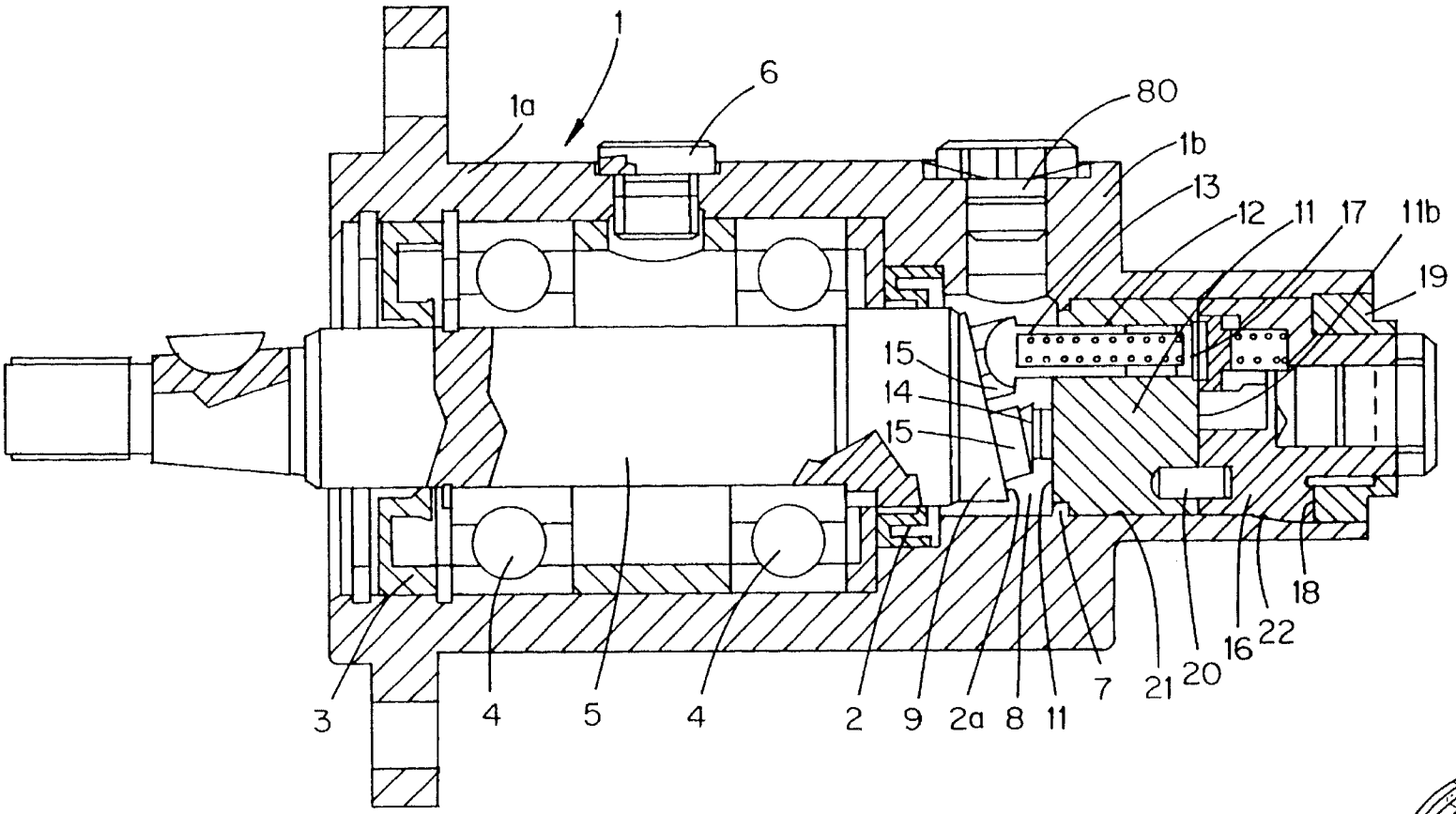
FIG. 1 is a side elevational view in section of a pump constructed in accordance with the principles of the present invention.
Figure 3:
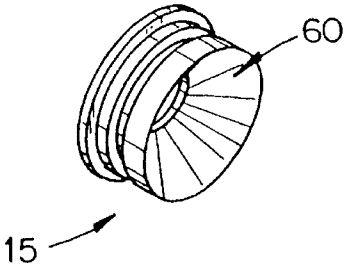
Figure 2:
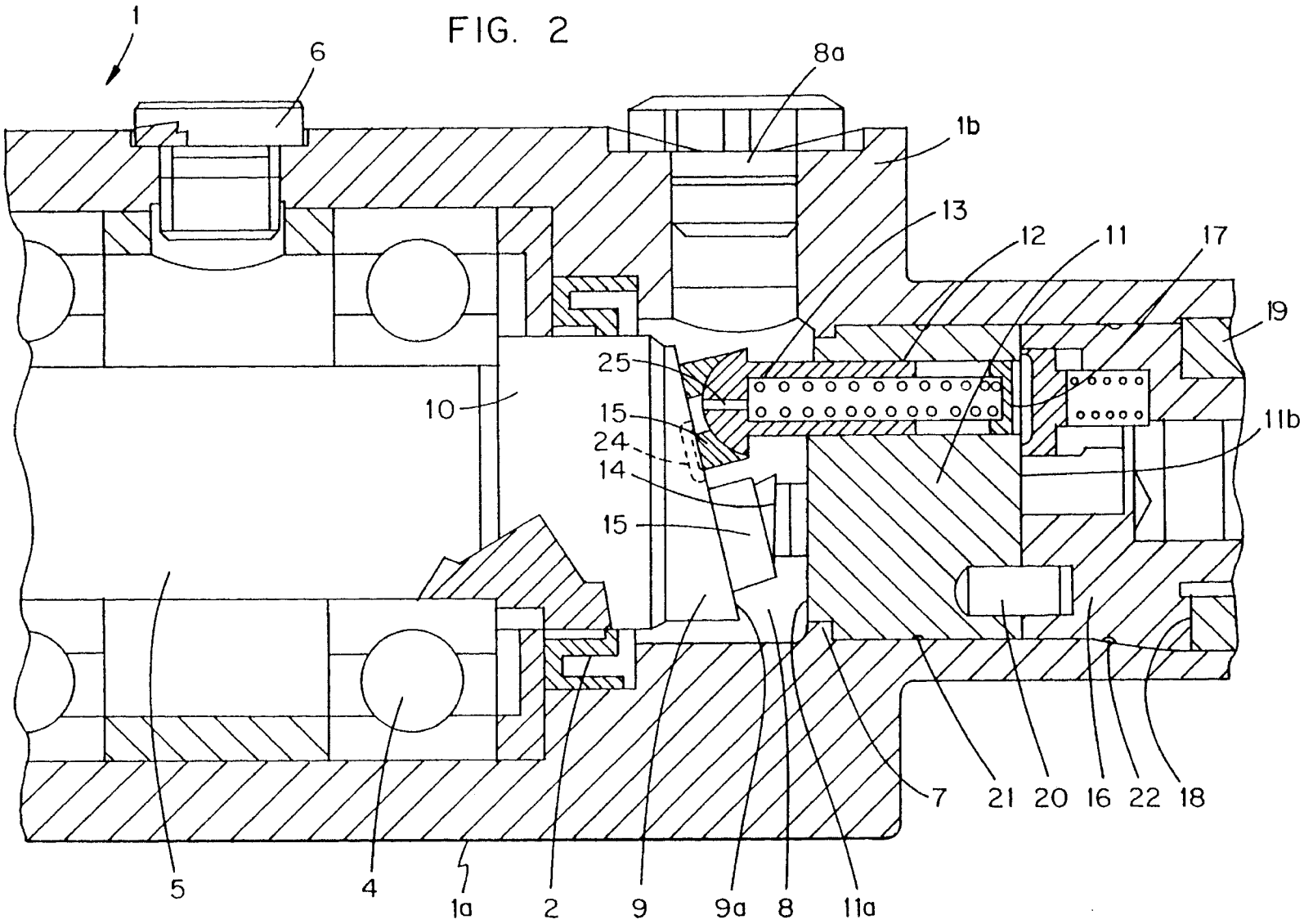
FIG. 2 is an enlarged sectional view of a portion of the pump shown in FIG. 1.

FIG. 1 shows that the pump casing 1 consists of two segments 1*a* and 1*b*, the borehole of segment 1*a* possibly being of different diameter than that of segment 1*b* and these two segments being separated from each other by a seal 2.

The first segment 1*a* is furthermore sealed by another seal 3 and ball bearings 4 are present between the two seals 2 and 3 which support the pump shaft 5. A plug 6 allows metering a quantity of lubricant present into the free space between the seals 2 and 3.

The inner borehole of segment 1*b* comprises a circular collar 7 serving as a stop.

A so-called intake chamber 8 is present on the side of the stop 7 facing the segment 1*a*, and an swash plate 9 rigidly affixed to the shaft 5 and evincing, in the present embodiment, a diameter approximately that of the shaft 5, moves inside this chamber 8.

A cylindrical bush 10 serving as a rest for the seal 2 is mounted between the inclined plate 9 and the shaft 5.

A cylindrical core 11 is mounted on the other side of the stop 7. This cylindrical core 11 comprises two planar parallel sides 11*a* and 11*b*. A plurality of boreholes 12, in this embodiment three, cross this core.

Each borehole 12 receives a hollow piston 13 of which the head 14 is part of a sphere and rests in the conical housing of a support stud 15 sliding on the surface 9*a* of the inclined plate 9.

In manner known per se, the surface 9*a* of the inclined plate is fitted with a crescent-shaped groove aperture schematically represented by passageway 24 through which the liquid in chamber 8 can cross the stud 15 and the head passageway 25 to enter the piston interior 13. The chamber 8 comprises an intake aperture 8*a*.

The front side of a second core 16 bearing a plurality of check-valves 17 each facing a borehole 12 (three in this instance) rests against the rear side 11*b* of the core 11.

At its rear this core 16 comprises a shoulder 18. A plug 19 is screwed into the inside bore of the segment 1*b* and rests against the shoulder 18 of the core 16 and thereby keeps the two cores 16 and 11 clamped against each other and resting against the circular stop 7. A locking pin 20 ensures proper mutual positioning of the two cores 16 and 11.

The pump shaft 5 is made of an alloy steel and was treated to have a Rockwell hardness 62 HRC. The side 9*a* of the swash plate was subjected to a sequence of, grinding, breaking-in and compound polishing to impart to it an arithmetic roughness Ra less than 0.2μ.

The studs 15 are made of bronze; their planar side is compound-ground to Ra=2μ. The conical housing of each of the studs 15 receiving the spherical piston head 14 first is polished to acquire a surface condition corresponding to the standard Ra=2μ; then a number of crossed grooves of a depth less than a hundredth of a mm is engraved in said surface. As a result a liquid film can be kept at the contacting circle between the cone and sphere even when the pump is shut down and thereby startup-seizure will be precluded.

The pistons 13 are made of alloy steel that was treated to acquire a Rockwell hardness of 62 HRC. The sphere of each piston is stone-ground so that its surface condition shall be Ra=1μ. This grinding is followed by compound polishing to achieve a mirror-polish. The core 11 is made of ball-bearing steel and was treated to acquire a core Rockwell hardness of 60 HRC.

Because the boreholes 12 are open-ended, their surface can be machined with the same accuracy as for the pistons and thereby they may acquire the same surface quality.

Finishing the rear side 11*b* of the casing 11 is by grinding, breaking-in and final polishing on marble to achieve a "broken-in/mirror" surface condition with a roughness Ra less than 2μ.

The check-valves 17 are made of high-grade steel and were treated to provide rupture strength of 1,800N/mm$^2$. Following this treatment these valves are broken-in in planar manner so that their surface condition be Ra=0.2μ, and then they are made glossy on a polishing marble to less than one "fringe" one fringe being a unit of planarity. Accordingly high sealing is achieved at the interface of the side 11*b* and the valves 17.

The nut 19 allows prestressing the cores 11 and 16 compressed against each other at a magnitude exceeding the maximum separation force that may be applied to them during pump operation.

Preferably these two cores shall be fitted with seals 21 and 22. However, because the inner borehole of segment 1*b* is open-ended and because the outer walls of the cores 11 and 16 are cylinders, these walls may be made in flawless surface condition and hence with such metal-to-metal sealing that the seals 21 and 22 practically remain unstressed and therefore retain their strength over time.

In the shown embodiment mode, the slope of the swash plate is such that the tangent is 0.2, namely an angle of 11.2°. Preferably this angle shall be between 10° and 15°. If the value is larger, the radial component of the forces applied to the piston becomes excessive and the pistons may seize within their boreholes.

The particular configuration of the pump makes it possible to employ two distinct segments separated from each other by the seal 2, namely segment 1*a* absorbing the larger stresses while being insulated from the fuel and flooded with a lubricant, only the second segment 1*b* being in contact with the fuel.

As a result of these steps taken together, a swash plate pump can be made which pumps not a hydraulic liquid with good viscosity (200 centistokes) but gasoline with a viscosity smaller by a factor of 400 (0.5 centistokes), and this performance is thereby achievable for the first time.

I claim:

1. A high-pressure pump to feed fuel injectors comprising a pump casing, an inclined plate (9) and hollow axial pistons (13) each piston having a spherical head (14) which rests against a stud (15) sliding on the inclined plate (9) which moves inside an intake chamber (8), the inclined plate 9 including a crescent-shaped aperture allowing to suck unleaded gasoline through the studs (15) and the spherical heads (14) into the pistons (13), characterized in that the pump casing (1) comprises:

a) two integral segments, a first segment (1*a*) comprising a cylindrical inner borehole receiving a pump shaft (5) and pump shaft ball bearings (4) and a second segment (1*b*) comprising another inner borehole receiving the inclined plate (9) rigidly affixed to the pump shaft (5), b) a first cylindrical core (11) with parallel sides (11*a*, 11*b*) and which is crossed by a plurality of open-end boreholes (12) receiving the pistons (13), c) a second cylindrical core (16) of which a planar front side is forced against a rear side (11*b*) of the first cylindrical core and bearing check-valves (17) opposite each borehole (12) and of which a rear part of said second cylindrical core (1*b*) comprises a circular shoulder (18), and a plug (19) screwed to the end of the inner borehole of the second segment (1*b*) of the pump casing (1), said plug (19) resting against the shoulder (18) of the second cylindrical core (16) in such a way as to compress the first and second cylindrical cores (11, 16) against each other with the first cylindrical core (11) resting against a circular stop (7) in the second segment (1*b*) of the pump casing (1), the inner boreholes of the two segments (1*a*, 1*b*) being separated from each other by a seal (2) in such manner that only parts located in the second segment (1*b*) shall be in contact with the unleaded gasoline.

2. Pump defined in claim 1, wherein the inner borehole of the first segment (1*a*) of the pump casing (1) is fitted with a second seal (3) in such manner that a space housing the ball bearings is sealed and filled with metered lubricant.

3. Pump defined in claim 1, characterized in that the inclined plate (9) evinces a slope between 10° and 15°.

4. Pump defined in claim 3, wherein the inclined plate (9) evinces a slope of 11.2°.

5. Pump defined in claim 1, wherein the sliding studs (15) are made of bronze, conical housings of these studs receiving the spherical heads (14) of the hollow pistons (13) being polished in a first step to a surface condition Ra=0.1μ and this surface then being grooved in crossed manner to an average depth less than one hundredth of a mm.

6. Pump defined in claim 1, wherein the core (11) comprising the boreholes (12) receiving the hollow pistons (13) is made of ball-bearing steel treated for a Rockwell core hardness of 60 HRC, said pistons (13) being made of alloyed steel treated to acquire a Rockwell hardness 62 HRC.

7. Pump defined in claim 6, wherein the spherical head (14) of each piston (13) is stone broken-in to achieve a surface condition of RA=0.1μ and then is compound-polished to achieve a mirror-polish.

8. Pump defined in claim 1, wherein the rear side (11*b*) of the core (11) comprising the boreholes (12) of the hollow pistons (13) is polished, finish-ground and broken in, and then is marble polished to achieve a "broken-in/mirror" finish with a roughness less than 0.2μ.

9. Pump defined in claim 1, wherein the side (9*a*) of the inclined plate (9) is finish-ground, broken-in and polished to achieve a surface condition with a roughness Ra less than 2μ.

10. Pump defined in claim 1, wherein the cores (11) and (16) are prestressed by the plug (19) so as to be compressed against each other by a force at least slightly larger than the maximum separation force they may be exposed to during operation.

11. Pump defined in claim 8, wherein the proper mutual positioning of the cores (11) and (16) is implemented by a pin (20).

12. Pump defined in claim 1, wherein the cores (11) and (16) are fitted with seals (21) and (22).

* * * * *